US010835771B2

(12) United States Patent
Bechtloff et al.

(10) Patent No.: US 10,835,771 B2
(45) Date of Patent: Nov. 17, 2020

(54) MIST EXTINGUISHING SYSTEM

(71) Applicant: MINIMAX GMBH & CO. KG, Bad Oldesloe (DE)

(72) Inventors: Volker Bechtloff, Bad Schwartau (DE); Dirk Blomke, Stockelsdorf (DE); Joachim Böke, Düsseldorf (DE)

(73) Assignee: Minimax GmnH & Co. KG, Bad Oldesloe (DE)

( * ) Notice: Subject to any disclaimer, the term of this patent is extended or adjusted under 35 U.S.C. 154(b) by 190 days.

(21) Appl. No.: 16/067,039

(22) PCT Filed: Dec. 15, 2016

(86) PCT No.: PCT/EP2016/081226

§ 371 (c)(1),
(2) Date: Jun. 28, 2018

(87) PCT Pub. No.: WO2017/129315

PCT Pub. Date: Aug. 3, 2017

(65) Prior Publication Data

US 2019/0009119 A1 Jan. 10, 2019

(30) Foreign Application Priority Data

Jan. 28, 2016 (DE) ..... 10 2016 201 235

(51) Int. Cl.
*A62C 35/58* (2006.01)
*A62C 35/60* (2006.01)
(Continued)

(52) U.S. Cl.
CPC ..... *A62C 35/58* (2013.01); *A62C 35/60* (2013.01); *A62C 35/68* (2013.01); *A62C 37/50* (2013.01)

(58) Field of Classification Search
CPC ..... A62C 35/58; A62C 35/60; A62C 35/68; A62C 37/50
(Continued)

(56) References Cited

U.S. PATENT DOCUMENTS 6,314,792 B1 * 11/2001 Cain ..... A62C 37/50 73/1.05
9,032,994 B2 * 5/2015 McHugh ..... A62C 37/50 137/563
(Continued)

FOREIGN PATENT DOCUMENTS

CN 101951993 1/2011
CN 102182929 9/2011
(Continued)

OTHER PUBLICATIONS

International Searching Authority, International Search Report in German & English translation in International Appln. No. PCT/EP2016/081226, dated Mar. 16, 2017, 5 pages.
(Continued)

*Primary Examiner* — Christopher S Kim
(74) *Attorney, Agent, or Firm* — Perkins Coie LLP

(57) ABSTRACT

The invention relates to a mist extinguishing system (1), comprising a line system (3) for connecting an extinguishing fluid supply and one or more extinguishing nozzles in a fluid-conducting manner, and a flow generator (7*a*, 7*b*) for swirling up solids (9) in the extinguishing fluid and/or for generating an extinguishing fluid flow within a measurement zone (11) of the line system (3), wherein a measuring device (5) for sensing the solids which are swirled up and/or conveyed through the measurement zone with the extinguishing fluid flow is arranged within the measurement zone (11). The invention also relates to a method for monitoring the function of a mist extinguishing system (1).

20 Claims, 2 Drawing Sheets

(51) Int. Cl.
*A62C 35/68* (2006.01)
*A62C 37/50* (2006.01)

(58) Field of Classification Search
USPC ..... 239/16
See application file for complete search history.

(56) References Cited

U.S. PATENT DOCUMENTS

| | | | | |
|---|---|---|---|---|
| 9,095,736 | B2 * | 8/2015 | Kochelek | F16L 55/1683 |
| 2004/0231862 | A1 * | 11/2004 | Kim | A62C 37/50 169/16 |
| 2008/0035201 | A1 | 2/2008 | Roberts | |
| 2008/0038809 | A1 | 2/2008 | Clausen et al. | |
| 2008/0308638 | A1 | 12/2008 | Hussey | |
| 2009/0038809 | A1 | 2/2009 | Sundholm | |
| 2011/0308638 | A1 | 12/2011 | Hyland et al. | |
| 2015/0021052 | A1 * | 1/2015 | Kochelek | A62C 35/60 169/16 |
| 2018/0193681 | A1 * | 7/2018 | Meyer | A62C 35/68 |
| 2019/0009119 | A1 * | 1/2019 | Bechtloff | A62C 35/58 |

FOREIGN PATENT DOCUMENTS

| | | |
|---|---|---|
| DE | 20 2010 015177 U1 | 3/2011 |
| EP | 1 593 410 | 11/2005 |
| JP | H 05-121391 A | 5/1993 |
| JP | H 11-233478 A | 8/1999 |
| KR | 10 2003 0045420 A | 6/2003 |
| WO | WO 2011/034334 A2 | 3/2011 |

OTHER PUBLICATIONS

International Searching Authority, Written Opinion in German & English translation in International Appln. No. PCT/EP2016/081226, dated Mar. 16, 2017, 13 pages.
English translation of Office Action, Korean Application No. 10-2018-7024588, 16 pages (dated Aug. 30, 2019).

* cited by examiner

MIST EXTINGUISHING SYSTEM

PRIORITY CLAIM AND INCORPORATION BY REFERENCE

This application is a 35 U.S.C. § 371 application of International Application No. PCT/EP2016/081226, filed Dec. 15, 2016, which claims the benefit of German Application No. 10 2016 201 235.5, filed Jan. 28, 2016, each of which is incorporated by reference in its entirety.

TECHNICAL FIELD

The invention relates to a mist extinguishing system comprising a line system for connecting an extinguishing fluid supply and one or more extinguishing nozzles in a fluid-conducting manner. "Extinguishing systems" are understood here as stationary installations which are provided in buildings, on ships or the like. Extinguishing vehicles are not to be understood as "extinguishing systems".

The invention further relates to a method for monitoring the function of a mist extinguishing system.

BACKGROUND AND SUMMARY OF THE INVENTION

Mist extinguishing systems are adapted to stay in a state of readiness until an extinguishing case occurs in order to then change from a state of readiness into an operating state. In the operating state they spray the extinguishing fluid very finely due to special nozzles and sprinklers and elevated operating pressures so that the entire surface of the dispensed extinguishing fluid is enlarged considerably. In this way, the extinguishing fluid can absorb heat more rapidly so that an evaporation of the extinguishing fluid occurs at an early stage. The accompanying cooling and smothering effect enables a particularly rapid fire fighting with reduced use of extinguishing fluid.

The degree of contamination of the extinguishing fluid plays a decisive role in the area of mist extinguishing systems compared to conventional extinguishing systems. This is attributable to the small nominal widths of the components used, for example, the small nozzle apertures of about 1 mm of the nozzles or sprinklers required to nebulize the extinguishing fluid. Even small impurities in the pipelines are swirled up in the case of a fire due to the flow rates that occur and are thus carried into the components with a small flow cross-section, Thus, solids can collect in the components so that the discharge of extinguishing fluid is impaired.

The contamination of the extinguishing fluid inside mist extinguishing systems can occur in various ways. During the assembly and filling of the mist extinguishing system, there is a considerable input of solids which results in contamination of the extinguishing fluid. Furthermore, in the case of long standing times of the extinguishing fluid in the pipelines, further contamination occurs as a result of precipitations of the solids from the extinguishing fluid.

In the prior art, various measures are known for reducing the contamination of the extinguishing fluid. For example, the pipelines used can be blown out with compressed air and then filled with filtered extinguishing fluid. However, the known measures have in common that these require manual maintenance or service work and must be performed at regular time intervals with deployment of staff.

In some areas of application of mist extinguishing systems however, it is not readily possible to perform such maintenance or service work. This applies particularly to fire fighting on ships. Ships are usually on the high seas for a long period of time, for example several months so that no maintenance or service work can be carried out by trained specialist staff. Mist extinguishing systems which have instruments for checking the operational readiness in particular in the state of readiness are not known in the prior art. Another disadvantage in the area of usage on ships is that occasionally only process water or in the worst case scenario seawater is available as extinguishing water supply which occasionally has a significantly higher solid contamination than tap water available on dry land.

It is therefore the object of the invention to provide a solution which allows the operational readiness of a mist extinguishing system to be monitored automatically and continuously even when the mist extinguishing system is in the state of readiness.

The object is solved by a mist extinguishing system of the type mentioned initially whereby this comprises at least one flow generator for swirling up solids in the extinguishing fluid within a measurement zone of the line system, wherein a measuring device for sensing the swirled-up solids is arranged within the measurement zone. The flow generator is adapted to be operated whilst the mist extinguishing system is in a state of readiness and forms a dedicated unit. In other words, the flow generator is not the (main) pump which drives the extinguishing agent to the nozzles in the operating state.

The state of readiness is that state of the mist extinguishing system in which no extinguishing agent emerges from the nozzles.

The invention makes use of the finding that the flow generator not only generates a flow of the extinguishing fluid but at the same time sets the extinguishing fluid into a state which makes it possible to detect the solids which are swirled up or conveyed through the measurement zone with the extinguishing fluid flow and thus detect the contamination of the extinguishing fluid.

Preferably the measuring device is adapted for quantitative sensing of the solids and comprises a particle measuring device, particularly preferably an extinction counter which operates on the principle of light blockade. The extinction counter comprises a light source and a light detection unit. The light source and the light detection unit are arranged in the measurement zone of the mist extinguishing system so that the solids which are swirled up by the flow generator partially reflect and absorb the light generated by the light source. The value recorded by the light detection unit varies depending on the distribution, the number and the size of the swirled-up particles. In this way, the measuring device of the mist extinguishing system can quantitatively detect the swirled up particles inside the measurement zone. In addition to the preceding example, other methods are understood under quantitative detection which include a relative or absolute numerical detection of the solid component in the extinguishing fluid, either by means of direct detection of the solids or by means of detection of solid-influenced properties of the extinguishing fluid, for example electrical and/or thermal conductivity and/or rheological properties.

Preferably water is used as extinguishing fluid. It is further preferred that the extinguishing fluid has additives such as foaming agents or frost protection agents.

In a preferred embodiment of the mist extinguishing system according to the invention, the line system is connected to one or more extinguishing nozzles in a fluid-conducting manner. Preferably the extinguishing nozzles are configured as high-pressure nozzles. Further preferred are high-pressure nozzles which have a screen at the nozzle inlet, wherein the screen fabric preferably has a mesh size of 0.9 mm, a wire diameter of 0.3 mm and a free screen area of at least 250 mm2. Alternatively the mist extinguishing system comprises low-pressure nozzles which are designed for pressures below 12 bar. By using low-pressure nozzles with a less fine screen fabric, the risk of a nozzle blockage is further reduced.

In an advantageous embodiment of the mist extinguishing system according to the invention, the flow generator is adapted to produce a flow with a predetermined flow rate inside the measurement zone.

In a preferred embodiment, the predetermined flow rate is equal to or greater than the flow rate inside the line system during an extinguishing process of the mist extinguishing system. In this way it is ensured that the flow generator brings about a flow state which is comparable to the flow state during an extinguishing process of the mist extinguishing system. Since the flow rate generated by the flow generator inside the measurement zone is greater than or equal to the flow rate inside the line system during an extinguishing process of the mist extinguishing system, a "worst-case" scenario is simulated for an extinguishing process and it is ensured that the maximum swirling up of solids to be expected in the case of an actual extinguishing process is already correctly imaged during the solid measurement in the measurement zone. In particular, the flow generator is configured to generate within the measurement zone a flow rate in the range of 20 m/s to 50 m/s, further preferably a flow rate in the range of 30 m/s to 40 m/s or a flow rate of about 34 m/s. This configuration comes into consideration in particular when the measurement system is arranged in a main line of the line system.

In a further preferred embodiment of the mist extinguishing system according to the invention, the flow generator is configured as a pump. The configuration of the flow generator as a pump is particularly advantageous when an extinguishing fluid circuit is formed inside the line system in which an extinguishing fluid circulation is produced by the pump. Here both the pump and also the measurement zone of the mist extinguishing system is arranged inside the extinguishing fluid circuit.

The mist extinguishing system is advantageously further configured in that the flow generator is configured as a propeller, wherein the propeller is preferably configured as part of an agitator. The configuration of the flow generator as a propeller is particularly preferred when the line system of the mist extinguishing system has a stub which branches off from the main line, at the end of which a fluid chamber is arranged (also designated hereinbefore and hereinafter as branching-off fluid chamber). Preferably the flow generator and the measurement zone of the mist extinguishing system is arranged inside the fluid chamber. The stub and the fluid chamber adjoining the stub create a separate measurement zone in which the solid contamination of the extinguishing fluid can be determined. Preferably the agitator comprises a magnetic agitator wherein the propeller of the agitator is driven by a magnet. The fluid chamber is preferably configured as a stainless steel container or as a container made of a non-magnetic material. By using a magnetic stirrer, the need for sealing of the drive with respect to the surroundings is overcome so that an additional seal of the drive components is not necessary.

Particularly preferably the mist extinguishing system comprises an evaluation unit to determine the solid component and/or the extinguishing fluid flow rate inside the measurement zone. Preferably the evaluation unit is connected to the measuring device in a signal-conducting manner. The evaluation unit is in particular adapted to store and/or send the data received from the measuring device. Further preferred is an evaluation unit which comprises a transmitting unit and/or a receiving unit which is/are configured for wireless and/or wired transmission of data. Preferably the evaluation unit comprises an input interface such as for example a touchscreen or push buttons and/or an information display such as, for example, a display. Further preferred is an evaluation unit which has an interface for connection of data transmission means. Such interfaces are, for example USB interfaces or interfaces for memory cards.

In a preferred embodiment of the mist extinguishing system according to the invention, the evaluation unit is adapted to compare the specific solid component inside the measurement zone with a solid component limiting value and/or to compare the specific extinguishing fluid flow rate inside the measurement zone with an extinguishing fluid flow rate limiting value. Preferably the evaluation unit has a memory in which the solid component limiting value or the extinguishing fluid flow rate limiting value is stored. The memory is preferably connected to the interface for connection of data transmitting means and/or to the transmitting unit and/or the receiving unit of the evaluation unit in a signal-conducting manner so that so that various solid component limiting values or the extinguishing fluid flow rate limiting value can be stored in the memory of the evaluation unit. By comparing the specific solid component within the measurement zone with a solid component limiting value it can be checked whether the operational readiness of the mist extinguishing system is ensured despite a certain contamination of the extinguishing fluid. By comparing the specific extinguishing fluid flow rate within the measurement zone with an extinguishing fluid flow rate limiting value, it can also be checked whether the operational readiness of the mist extinguishing system is ensured despite a certain contamination of the extinguishing fluid.

In a further embodiment of the mist extinguishing system according to the invention, an extinguishing fluid monitoring device is connected to the evaluation unit in a signal-conducting manner for delivering a warning signal when the solid component limiting value is exceeded or the extinguishing fluid flow rate falls below the limiting value. Preferably the extinguishing fluid monitoring device is adapted to deliver a warning to a continuously occupied position. The warning signal is preferably a visual or audible warning signal. Alternatively the warning signal is a data signal which notifies a fire alarm and/or extinguishing control centre that the solid component limiting value has been exceeded.

In an advantageous further development of the mist extinguishing system according to the invention, the line system comprises a fluid circuit wherein the measurement zone is arranged inside the fluid circuit. A ring line system is formed by the fluid circuit inside the line system in which a continuous circulation of extinguishing fluid can be produced by the flow generator.

Further preferred is a mist extinguishing system in which the flow generator is arranged inside the fluid circuit, wherein preferably a fluid valve is connected upstream and/or a fluid valve is connected downstream of the flow generator. As a result of the upstream and downstream fluid valves, the flow state within the measurement zone can be adjusted largely independently of the power of the flow generator.

Further preferred is a mist extinguishing system with one or more additional shutoff valves for shutting off the fluid circuit with respect to the extinguishing fluid supply and/or the one or the plurality of fluid nozzles. Preferably the shut-off valves are fitted with a monitoring device which continuously monitors the operating state of the shut-off valves. Alternatively or additionally the shut-off valves are secured in an operationally ready position.

In a particularly preferred embodiment of the mist extinguishing system according to the invention, the line system has a branching-off fluid chamber.

Preferably the measurement zone and further preferably the flow generator are arranged inside the fluid chamber.

Preferably the fluid chamber is arranged as a, or in a, stub or branch line inside the line system. Further preferred is a mist extinguishing system which has one or more additional shut-off members, in particular shut-off valves for shutting off the fluid chamber with respect to the fluid supply and/or the one or several extinguishing nozzles.

In a further preferred embodiment the fluid circuit extends from and towards the branching-off fluid chamber. In other words, the fluid circuit branches off from the fluid chamber and opens again into the fluid chamber. During the passage of extinguishing fluid through the fluid circuit, the extinguishing fluid is also forcibly (at least turbulently) set in motion in the branching off fluid chamber. Particularly preferably the branching-off fluid chamber can be separated from a main line by means of corresponding shut-off members so that a flow for measurement purposes can also be generated independently of the actual flow in the main line.

Preferably a first flow generator for generating an extinguishing fluid flow having a predetermined flow rate is arranged in the fluid circuit and a second flow generator for swirling up solids in the extinguishing fluid is arranged in the fluid chamber. The first flow generator and the second flow generator are preferably active here divided according to the task. The first flow generator is adapted to produce a predetermined flow rate in the fluid circuit where the measurement zone is also located. The second flow generator is adapted to swirl up solids in the fluid chamber and thus increase the number of solids which are entrained by the forced flow and conveyed into the fluid circuit. The arrangement of the fluid circuit released from the main line but branching off from an already branched off fluid chamber has the following advantage: if the fluid chamber in normal operation is connected in a fluid-conducting manner to the main line, an increased input of solids into the fluid chamber takes place as a result of the branching off and as a result of flow turbulences. Therefore if a specific solid contamination is measured in the fluid chamber or in the fluid circuit adjoining the fluid chamber, it can be assumed with some certainty that the concentration is equal to or greater than the concentration in the main line, which minimizes the risk of inadvertently underestimating the contamination of the extinguishing fluid. In addition, it is possible to use a measuring device with a smaller range of measured values and higher measurement sensitivity in the fluid circuit and tune the extinguishing fluid flow forced by the first current generator exactly to the optimal working point of the measuring device. The second flow generator in this case undertakes primarily supporting tasks by promptly ensuring a swirling up of solids from the fluid chamber base.

The mist extinguishing system is further advantageously configured in that a screen is arranged upstream of the measurement zone, which has a screen opening through which the extinguishing fluid can flow. Preferably the measuring device is configured as a magnetically inductive flowmeter.

In a further preferred embodiment of the mist extinguishing system according to the invention, the flow generator is adapted to set a flow rate predefined by the measuring device inside the measuring zone or a flow state predefined by the measuring device. In particular, in those embodiments in which the measurement zone is not arranged in the main line but in a branching-off chamber or in particular in a fluid circuit which branches off from the main line or the fluid chamber, a measuring device is preferably provided for (quantitative) detection of solids with higher measurement sensitivity which is preferably tuned to a reduced flow rate compared to the real extinguishing case in the main line, possibly in the range of 5 m/s or less.

In an alternative preferred embodiment of the mist extinguishing system according to the invention, the one or the plurality of extinguishing nozzles each have a nozzle opening and the size of the screen opening substantially corresponds to the size of the nozzle opening. This is particularly preferably used when the contamination or solid contamination is to be determined by means of a flow rate measurement. In an alternatively preferred embodiment, the size of the screen opening is adapted to set an optimized flow rate for the measuring device for the quantitative detection of solids in the measurement zone.

The size of the screen opening is preferably variably adjustable.

The object forming the basis of the invention is further solved by a method for monitoring the function of a mist extinguishing system of the type mentioned initially, whereby the method comprises the following steps:

- providing a mist extinguishing system, preferably a mist extinguishing system according to one of the previously described embodiments, comprising a line system for the fluid-conducting connection of an extinguishing fluid supply and one or more extinguishing nozzles in a state of readiness,
- swirling up solids in the extinguishing fluid inside a measurement zone of the line system and/or generating an extinguishing fluid flow inside the measurement zone whilst the mist extinguishing system is in a state of readiness and
- sensing the solids which are swirled up and/or conveyed through the measurement zone with the extinguishing fluid flow inside the measurement zone.

With regard to the advantages of the preferred embodiments of the method according to the invention, reference is made to the advantages and preferred embodiments of the mist extinguishing system according to the invention.

A particularly preferred embodiment of the method according to the invention comprises one, several or all of the following steps:

- determining the solid component inside the measurement zone;
- determining the extinguishing fluid flow rate;
- comparing the specific solid component with a solid component limiting value;
- comparing the extinguishing fluid flow rate with an extinguishing fluid flow rate limiting value;
- delivering a warning signal when the solid component limiting value is exceeded,
- delivering a warning signal when the extinguishing fluid flow rate fall below the limiting value.

Another preferred embodiment of the method according to the invention comprises one, several or all of the following steps:

- providing a fluid circuit inside the line system, wherein the measurement zone is arranged inside the fluid circuit;
- shutting off the fluid circuit with respect to the extinguishing fluid supply and/or the one or more extinguishing nozzles;
- swirling up solids in the fluid chamber;
- generating an extinguishing fluid flow inside the fluid circuit.

The method according to the invention is further configured by one, several or all of the following steps:

- providing a fluid chamber inside the line system, wherein the measurement zone is arranged inside the fluid chamber;
- shutting off the fluid chamber with respect to the extinguishing fluid supply and/or the one or more extinguishing nozzles;
- generating an extinguishing fluid flow inside the fluid chamber.

A further preferred embodiment of the method according to the invention comprises at least one of the following steps:

- providing a screen inside the line system in such a manner that the extinguishing fluid flows through the screen opening and the measurement zone is located downstream of the screen, wherein the size of the screen opening preferably substantially corresponds to the size of the nozzle opening;
- measuring the extinguishing fluid flow, in particular the extinguishing agent flow rate in the measurement zone.

Preferably the device according to one of the previously described preferred embodiments is used to carry out the method. The preferred embodiments of the device are therefore at the same time preferred embodiments of the method and conversely.

BRIEF DESCRIPTION OF THE DRAWINGS

The invention is described in detail in the following with reference to the appended figures by means of preferred exemplary embodiments. Identical reference numbers are used for functionally or structurally the same elements of different exemplary embodiments. The figures are understood such that elements which are merely shown explicitly in individual exemplary embodiments can also be used at least optionally in the other exemplary embodiments unless technically excluded.

In the figures.

MODE(S) FOR CARRYING OUT THE INVENTION

Figure 1:
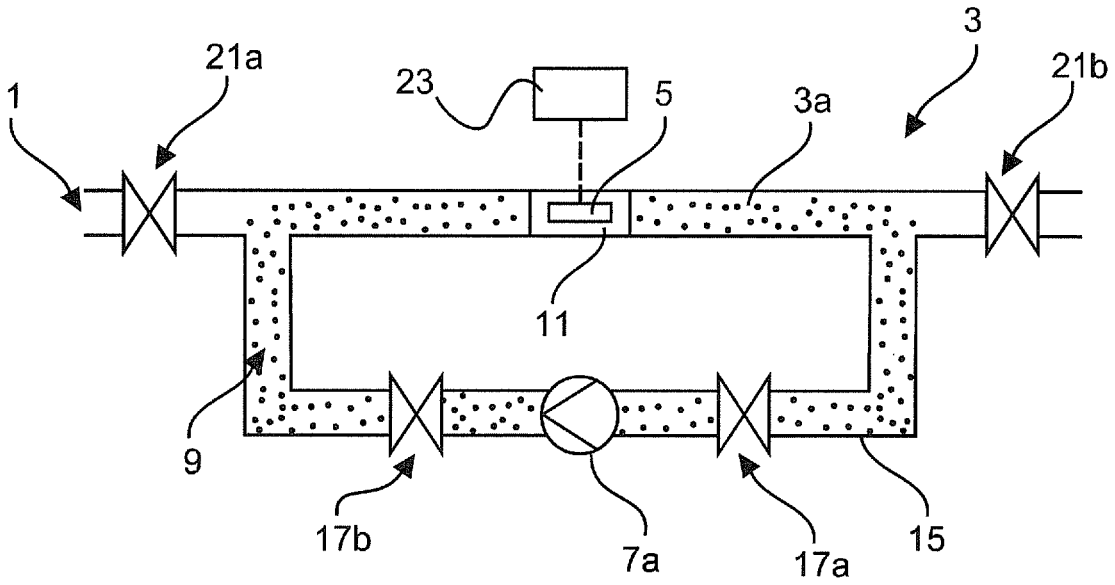
FIG. 1 shows an exemplary embodiment of the mist extinguishing system according to the invention in a schematic view.

According to FIG. 1, the mist extinguishing system 1 comprises a line system 3 which comprises a main line 3*a* and can be connected in a fluid-conducting manner to an extinguishing fluid supply and a plurality of extinguishing nozzles (not shown). The mist extinguishing system 1 further comprises a flow generator 7*a* for generating an extinguishing fluid flow and thereby also for swirling up solids 9 in the extinguishing fluid inside a measurement zone 11 of the line system 3. A measuring device 5 for detecting the swirled-up solids 9 is arranged inside the measurement zone 11.

The flow generator 7*a* is adapted to generate a predetermined extinguishing fluid flow rate inside the measurement zone 11 which preferably corresponds to the extinguishing fluid flow rate inside the line system 3 during an extinguishing process of the mist extinguishing system 1. Alternatively the extinguishing fluid flow rate is preferably adapted to the measured value range of the measuring device 5. The flow generator 7*a* is configured as a pump and arranged inside a fluid circuit 15 of the line system 3, wherein the measurement zone 11 is also arranged inside the fluid circuit 15. A shut-off member configured as fluid valve 17*a* is arranged upstream of the flow generator 5*a* and a shut-off member configured as fluid valve 17*b* is arranged downstream.

The measuring device 5 is connected in a signal-conducting manner to an evaluation unit 23 to determine the solid component inside the measurement zone 11. The evaluation unit 23 preferably comprises a touchscreen as well as one or a plurality of operating elements, for example, push buttons (not shown). For wireless communication with external devices such as, for example, a fire alarm and/or extinguishing control centre, the evaluation unit 23 has a transmitting unit and a receiving unit (not shown) which is adapted to transmit data in a wireless manner.

The evaluation unit 23 is adapted to compare the specific solid component inside the measurement zone 11 with a solid component limiting value. The evaluation unit 23 further has a memory in which the solid component limiting value is stored. The evaluation unit 23 is adapted to communicate with an extinguishing fluid monitoring device (not shown) so that the extinguishing fluid monitoring device can deliver a warning signal if the solid component limiting value is exceeded.

The mist extinguishing system 1 furthermore has two additional shut-off valves 21*a*, 21*b* for shutting off the fluid circuit 15 with respect to the extinguishing fluid supply and the plurality of extinguishing nozzles.

Figure 2:
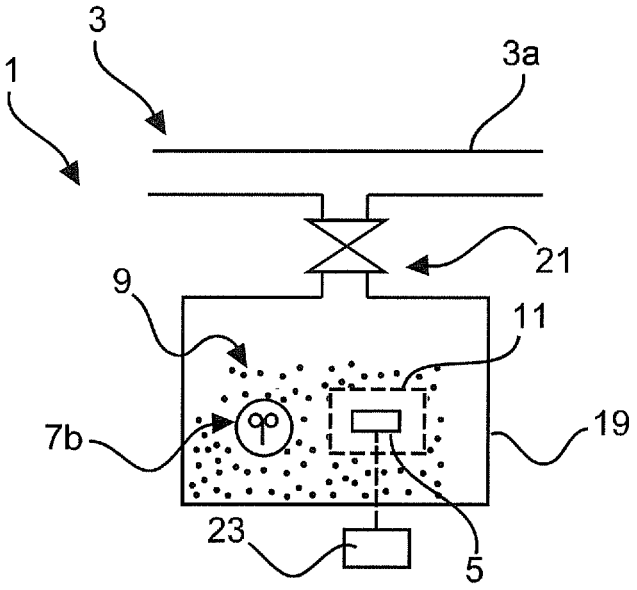
FIG. 2 shows another exemplary embodiment of the mist extinguishing system according to the invention in a schematic view.

According to FIG. 2, in a further embodiment the mist extinguishing system 1 according to the invention has a line system 3 which can be connected to an extinguishing fluid supply and a plurality of extinguishing nozzles in a fluid-conducting manner. The line system 3 further comprises a stub which branches off from the main line 3*a* in which a shut-off valve 21 is arranged.

The line system 3 furthermore has a fluid chamber 19 in the stub in which a flow generator 7*b* is arranged for swirling up solids in a measurement zone 11. A measuring device 5 for detecting the swirled up solids 9 is arranged inside the measurement zone 11. The signal generator 7*b* is configured as a propeller, wherein the propeller is part of an agitator. The agitator is in turn preferably configured as a magnetic stirrer so that the propeller of the agitator is driven by a magnet. The fluid chamber 19 is preferably configured as a stainless steel container.

The measuring device 5 according to FIG. 2 and also according to FIG. 1 is connected in a signal-conducting manner to an evaluation unit 23 for quantitative determination of the solid component within the measurement zone 11. The evaluation unit 23 is adapted to compare the specific solid component within the measurement zone 11 with a solid component limiting value. The evaluation unit 23 comprises a memory in which the solid component limiting value is stored. The evaluation unit 23 is adapted to communicate with an extinguishing fluid monitoring device wherein the extinguishing fluid monitoring device is configured to deliver a warning signal if the solid component limiting value is exceeded.

Figure 3:
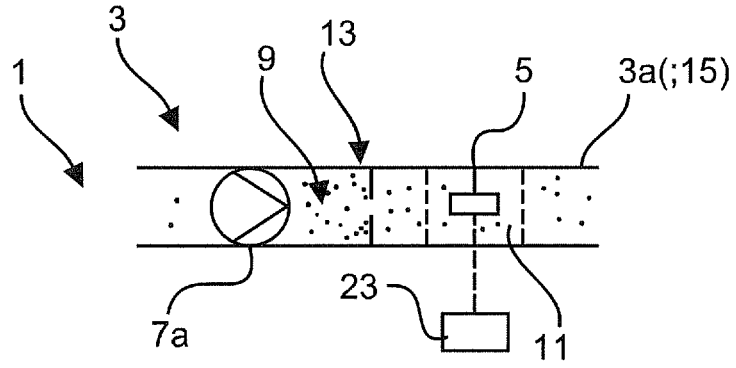
FIG. 3 shows another exemplary embodiment of the mist extinguishing system according to the invention in a schematic view and FIG. 4 shows another exemplary embodiment of the mist extinguishing system according to the invention in a schematic view.

According to FIG. 3, the mist extinguishing system 1 according to the invention comprises a line system 3 for connecting an extinguishing fluid supply to a plurality of extinguishing nozzles in a fluid-conducting manner. Inside the line system 3 a flow generator 7*a* which is designed as a pump for generating an extinguishing fluid flow and accompanying this, for swirling up solids 9 is arranged in the main line 3*a*. The mist extinguishing system 1 furthermore comprises a measuring device 5 which is arranged within a measurement zone 11 for detecting the swirled-up solids 9. The measuring device 5 is adapted to measure the extinguishing fluid flow rate in the measurement zone 11, wherein a screen 13 is arranged upstream of the measurement zone 11 which has a screen opening through which the extinguishing fluid can flow.

The plurality of extinguishing nozzles to which the line system 3 is connected in a fluid-conducting manner each have a nozzle opening wherein preferably the size of the screen opening substantially corresponds to the size of the nozzle opening.

The evaluation unit 23 in the exemplary embodiment according to FIG. 3 is adapted to compare the extinguishing fluid flow rate measured inside the measurement zone 11 with an extinguishing fluid flow rate limiting value. The evaluation unit 23 further comprises a memory in which the extinguishing fluid flow rate limiting value is stored. The evaluation unit 23 is adapted to communicate with an extinguishing fluid monitoring device so that the extinguishing fluid monitoring device can deliver a warning signal when the extinguishing fluid flow rate falls below the limiting value.

Whereas in the exemplary embodiments according to FIGS. 1 to 3, only a single flow generator 7*a* or 7*b* was used in each case, in the following exemplary embodiment according to FIG. 4 a synthesis from the preceding exemplary embodiments is presented. The mist extinguishing system 1 according to FIG. 4 has a fluid chamber 19 which branches off from the main line 3*a* of the line system 3. A fluid circuit 15 extends out from the fluid chamber 19 and opens again into this. The fluid circuit 15 can be separated from the fluid chamber 19 by means of corresponding shut-off members 17*a, b* or can be connected to this in a fluid-conducting manner.

A first flow generator 7*a*, preferably in the form of a circulating pump, is arranged in the fluid circuit 15 and is adapted to set a predetermined flow rate of the extinguishing fluid in the fluid circuit 15. Downstream of the first flow generator 7*a*, the measurement zone 11 is arranged in the fluid circuit, in this respect similar to the exemplary embodiment according to FIG. 1, only with the difference that the measurement zone 11 here is explicitly not formed in the main line 3*a* but in the separately branched-off fluid circuit 15.

A measuring device 5 is arranged in the measurement zone 11, which is connected in a known manner to the evaluation unit 23 in a signal-conducting manner. With reference to the function of the evaluation unit, reference is made to the previous exemplary embodiments.

In addition to the first flow generator 7*a* in the fluid circuit 15 however, a second flow generator 7*b* is additionally arranged in the branching-off fluid chamber 19 for swirling up solids in the fluid chamber 19. The second flow generator 7*b* is in particular suitable for swirling up sedimented solids which, when the fluid chamber 19 is open (a shut-off member between main line 3*a* and fluid chamber 19 is not shown here by can be optionally provided) can collect in the course of time and/or during operation of the mist extinguishing system as a result of turbulent flows in the main line 3*a*.

The second flow generator 7*b* increases the concentration of solids in the fluid circuit 15 as a result of the swirling up of the solids when the first flow generator 7*a* brings about forced convection.

Figure 4:
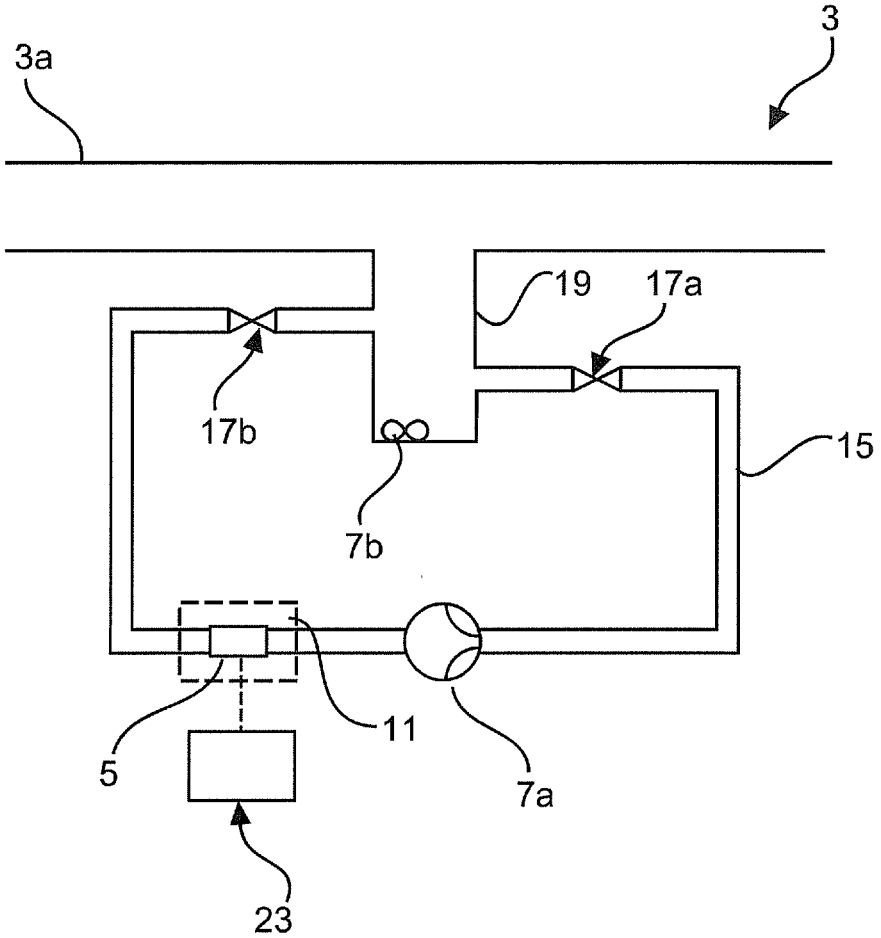

Optionally in the exemplary embodiment according to FIG. 4, a screen as shown in FIG. 3 is arranged upstream of the first flow generator 7*a*. The screen has a screen opening as in the afore-mentioned exemplary embodiment in order to manipulate the flow rate in a desired manner.

LIST OF UTILIZED REFERENCE NUMBERS

1 Mist extinguishing system
3 Line system
3*a* Main line
5 Measuring device
7*a*, 7*b* Flow generator
9 Solids
11 Measurement zone
13 Screen
15 Fluid circuit
17*a*, 17*b* Shut-off members
19 Fluid chamber
21, 21*a*, 21*b* Shut-off valves
23 Evaluation unit

The invention claimed is:

1. A mist extinguishing system, comprising a line system for connecting an extinguishing fluid supply and one or more extinguishing nozzles in a fluid-conducting manner, the line system having a measurement zone;

at least one flow generator for swirling up solids in an extinguishing fluid and/or for generating an extinguishing fluid flow with solids, the at least one flow generator being adapted to be operated whilst the mist extinguishing system is in a state of readiness, and a measuring device arranged within the measurement zone, the measuring device sensing the solids which are swirled up in the extinguishing fluid and/or the solids in the extinguishing fluid flow conveyed through the measurement zone with the extinguishing fluid flow arranged within the measurement zone.

2. The mist extinguishing system according to claim 1, wherein the at least one flow generator is adapted to produce the extinguishing fluid flow with a predetermined flow rate inside the measurement zone.

3. The mist extinguishing system according to claim 2, wherein the flow rate inside the measurement zone is equal to or greater than an extinguishing fluid flow rate inside the line system during an extinguishing process of the mist extinguishing system.

4. The mist extinguishing system according to claim 1, wherein the at least one flow generator is configured as a pump.

5. The mist extinguishing system according to claim 1, wherein the at least one flow generator is configured as a propeller, and wherein the propeller is configured as part of an agitator.

6. The mist extinguishing system according to claim 1, further comprising an evaluation unit connected to the measuring device in a signal-conducting manner to determine a solid component and/or an extinguishing fluid flow rate inside the measurement zone.

7. The mist extinguishing system according to claim 6, wherein the evaluation unit is adapted to compare a specific solid component inside the measurement zone with a solid component limiting value and/or to compare a specific extinguishing fluid flow rate inside the measurement zone with an extinguishing fluid flow rate limiting value.

8. The mist extinguishing system according to claim 7, further comprising an extinguishing fluid monitoring device connected to the evaluation unit in a signal-conducting manner for delivering a warning signal when the solid component limiting value is exceeded or the extinguishing fluid flow rate falls below the limiting value.

9. The mist extinguishing system according to claim 1, wherein the line system comprises a fluid circuit, and wherein the measurement zone is arranged inside the fluid circuit.

10. The mist extinguishing system according to claim 9, wherein the at least one flow generator is arranged inside the fluid circuit, and wherein a fluid valve is connected upstream and/or a fluid valve is connected downstream of the at least one flow generator.

11. The mist extinguishing system according to claim 1, wherein the line system has a branching-off fluid chamber.

12. The mist extinguishing system according to claim 11, wherein the measurement zone and the at least one flow generator are arranged inside the branching-off fluid chamber.

13. The mist extinguishing system according to claim 11, wherein a fluid circuit extends from and towards the branching-off fluid chamber.

14. The mist extinguishing system according to claim 13, wherein the at least one flow generator comprises a first flow generator for generating the extinguishing fluid flow having a predetermined flow rate arranged in the fluid circuit and a second flow generator for swirling up solids in the extinguishing fluid arranged in the fluid chamber.

15. The mist extinguishing system according to claim 1, wherein a screen is arranged upstream of the measurement zone, which has a screen opening through which the extinguishing fluid can flow.

16. A method for monitoring the function of a mist extinguishing system comprising the steps:

providing a mist extinguishing system having a line system for connecting an extinguishing fluid supply and one or more extinguishing nozzles in a fluid-conducting manner, the line system having a measurement zone, at least one flow generator, and a measuring device arranged within the measurement zone, swirling up solids in an extinguishing fluid inside the measurement zone of the line system and/or generating an extinguishing fluid flow with solids inside the measurement zone of the line system whilst the mist extinguishing system is in a state of readiness, and sensing the solids which are swirled up in the measurement zone and/or the solids in the extinguishing fluid flow conveyed through the measurement zone with the extinguishing fluid flow inside the measurement zone.

17. The method according to claim 16, comprising at least one of the following steps:

determining a solid component inside the measurement zone;

determining an extinguishing fluid flow rate;

comparing a specific solid component with a solid component limiting value;

comparing the extinguishing fluid flow rate with an extinguishing fluid flow rate limiting value;

delivering a warning signal when the solid component limiting value is exceeded, and delivering a warning signal when the extinguishing fluid flow rate falls below the extinguishing fluid flow rate limiting value.

18. The method according to claim 16, comprising at least one of the following steps:

providing a fluid circuit inside the line system, wherein the measurement zone is arranged inside the fluid circuit;

shutting off the fluid circuit with respect to the extinguishing fluid supply and/or the one or more extinguishing nozzles; and generating the extinguishing fluid flow inside the fluid circuit.

19. The method according to claim 16, comprising at least one of the following steps:

providing a fluid chamber inside the line system, wherein the measurement zone is arranged inside the fluid chamber;

shutting off the fluid chamber with respect to the extinguishing fluid supply and/or the one or more extinguishing nozzles;

swirling up solids in the fluid chamber; and generating the extinguishing fluid flow inside the fluid chamber.

20. The method according to claim 16, comprising at least one of the following steps:

providing a screen inside the line system in such a manner that the extinguishing fluid flow flows through a screen opening, wherein the size of the screen opening substantially corresponds to the size of an opening of the one or more extinguishing nozzles, locating the measurement zone downstream of the screen, and measuring a rate of the extinguishing fluid flow in the measurement zone.

* * * * *